US011541562B2

(12) United States Patent
Cai et al.

(10) Patent No.: US 11,541,562 B2
(45) Date of Patent: Jan. 3, 2023

(54) CUTTING TOOL MECHANISM

(71) Applicant: TRIPLE WIN TECHNOLOGY (SHENZHEN) CO. LTD., Shenzhen (CN)

(72) Inventors: Mei Cai, Shenzhen (CN); Yen-Sheng Lin, New Taipei (TW); Xing Yu, Shenzhen (CN)

(73) Assignee: TRIPLE WIN TECHNOLOGY (SHENZHEN) CO. LTD., Shenzhen (CN)

( * ) Notice: Subject to any disclaimer, the term of this patent is extended or adjusted under 35 U.S.C. 154(b) by 0 days.

(21) Appl. No.: 17/330,967

(22) Filed: May 26, 2021

(65) Prior Publication Data

US 2021/0370537 A1 Dec. 2, 2021

(30) Foreign Application Priority Data

May 29, 2020 (CN) ..... 202010477659.1

(51) Int. Cl.
*B26D 1/04* (2006.01)
*B26D 7/26* (2006.01)
(Continued)

(52) U.S. Cl.
CPC ..... *B26D 1/04* (2013.01); *B26D 5/02* (2013.01); *B26D 7/02* (2013.01); *B26D 7/2628* (2013.01)

(58) Field of Classification Search
CPC . B26D 1/04; B26D 1/045; B26D 5/02; B26D 7/02; B26D 7/2628; B26D 7/2614; B26D 7/01; B26D 7/2642; B26D 2007/2685; B26D 2007/2678; B26D 1/205; B25B 27/00; B28D 5/02; B28D 1/225; Y10T 83/0385; Y10T 83/0348; Y10T 83/8748; Y10T 83/889; Y10T 83/9312; Y10T 83/7507; Y10T 83/8822;
(Continued)

(56) References Cited

U.S. PATENT DOCUMENTS 3,496,817 A * 2/1970 Staats ..... B26D 1/205 83/56
5,271,305 A * 12/1993 Peters ..... B26D 1/045 83/578
(Continued)

FOREIGN PATENT DOCUMENTS

CN 105729641 A * 7/2016
CN 105729641 A 7/2016
(Continued)

*Primary Examiner* — Jonathan G Riley
(74) *Attorney, Agent, or Firm* — ScienBiziP, P.C.

(57) ABSTRACT

A cutting tool mechanism comprises a base, a fixing module disposed on the base for fixing a product to be disassembled, a first moving mechanism disposed on a side of the fixing module, and a three-dimensional cutter rotatably disposed on the first moving mechanism and matched with the fixing module. The first moving mechanism extends in a first direction and is configured to drive the three-dimensional cutter to move in the first direction, and the three-dimensional cutter is configured to be driven to move in a second direction and in a third direction, each of the second direction and the third direction being perpendicular to the first direction.

7 Claims, 6 Drawing Sheets

(51) Int. Cl.
*B26D 5/02* (2006.01)
*B26D 7/02* (2006.01)

(58) Field of Classification Search
CPC ..... C03B 33/027; C03B 33/12; C03B 33/03; C03B 33/10; Y10S 83/953
See application file for complete search history.

(56) References Cited

U.S. PATENT DOCUMENTS 5,507,212 A * 4/1996 Morrison ..... B25H 7/04 83/564
6,467,384 B1 * 10/2002 Bromley ..... B26F 1/3806 83/455

FOREIGN PATENT DOCUMENTS

CN 207127974 U * 3/2018
CN 207127974 U 3/2018
CN 110394833 A 11/2019

* cited by examiner

CUTTING TOOL MECHANISM

FIELD

The subject matter herein generally relates to a cutting tool mechanism.

BACKGROUND

A camera module includes a lens, an infrared filter, an image sensor, a circuit board, a reinforcing sheet, and other components. The lens is configured to focus on a target for imaging on the photosensitive surface of the image sensor. The lens is a core part of the camera module, and the quality of the lens will affect the optical performance of the camera module. When testing the camera module, if any test items involves factors which may be detrimental to the lens, the camera module needs to be disassembled. The camera module is usually disassembled manually by using blades. However, the manual disassembly method is low in efficiency and accuracy, and it is difficult to accurately position the camera module during the disassembly process.

SUMMARY

In view of the above situation, it is necessary to provide a cutting tool mechanism that can accurately position the camera module during the disassembly process and improve the accuracy of disassembly and the efficiency of disassembly.

According to one embodiment, a cutting tool mechanism includes a base, a fixing module disposed on the base for fixing a product to be disassembled, a first moving mechanism disposed on a side of the fixing module, and a three-dimensional cutter rotatably disposed on the first moving mechanism and being matched with the fixing module. The first moving mechanism extends in a first direction and is configured to drive the three-dimensional cutter to move in the first direction, and the three-dimensional cutter is configured to be driven to move in a second direction and in a third direction, each of the second direction and the third direction being perpendicular to the first direction.

According to one embodiment, the fixing module includes a main body, a positioning groove defined on the main body, and a cutting channel defined on the main body, the positioning groove is configured to fix the product to be disassembled, the cutting channel communicates with the positioning grove, and an opening of the cutting channel faces the three-dimensional cutter which includes a blade, the blade is configured to be driven to extend into the cutting channel.

According to one embodiment, the first moving mechanism includes a guide rail and a moving portion disposed on the guide rail, the guide rail is disposed on a top surface of the base or disposed on a sidewall of fixing module, the three-dimensional cutter is rotatably disposed on the moving portion.

According to one embodiment, the three-dimensional cutter further includes a fixing base disposed on the moving portion, a second moving mechanism disposed on the fixing base, a lifting mechanism disposed on the second moving mechanism, and a blade holder disposed on the lifting mechanism, the blade is connected to the blade holder, the second moving mechanism is configured to drive the blade to move in the second direction, the lifting mechanism is configured to move the blade in the third direction.

According to one embodiment, the cutting tool mechanism further includes a rotating mechanism disposed on an end of the blade holder adjacent to the fixing module, wherein the blade is disposed on the rotating mechanism, the rotating mechanism is configured to drive the blade to rotate in a plane defined by the first direction and the second direction.

According to one embodiment, the cutting tool mechanism further includes a fixing device disposed on a bottom or a sidewall of the positioning groove.

According to one embodiment, a groove is defined on the bottom of the positioning groove, the fixing device is disposed in the groove.

According to one embodiment, the fixing device is a magnetic device.

According to one embodiment, the second moving mechanism includes a push rod extending in the second direction and an elastic member, an end of the push rod is connected to the lifting mechanism, an end of the elastic member is connected to lifting mechanism, and the elastic member and the push rod are located on either side of the lifting mechanism respectively.

According to one embodiment, the lifting mechanism includes a lifting plate sleeved on the second moving mechanism, an opening defined on the lifting plate, a positioning rod extending through the opening, and a positioning head disposed on an end of the positioning rod, the blade holder is disposed on the other end of the positioning rod, the blade holder and the positioning head are located on either side of the lifting plate respectively.

Compared with the prior art, the cutting tool mechanism has the following beneficial effects. First, the structure of the cutting tool assembly is simple, it is easy to disassembly and assembly, the hardness is large, and the cost is low. Second, the circular blade can balance the forces on the products to be disassembled, the camera can be disassembled at one time by using the circular blade, so that the integrity of the lens can be maintained. Third, the three-dimensional cutter is an automatically controlled cutter, the three-dimensional cutter cooperates with the moving mechanism to realize rotary cutting, which improves the safety and accuracy of operation, and effectively reduces the risk of scratches on the bottom of the lens in the camera module. Fourth, a plurality of positioning grooves suitable for a plurality of products are defined, the disassembly efficiency is improved; the product is fixed by a magnetic device, the positioning accuracy of the product is improved. Fifth, it realizes automatic control, the safety is improved.

BRIEF DESCRIPTION OF THE DRAWINGS

Implementations of the present technology will now be described, by way of embodiment, with reference to the attached figures.

DETAILED DESCRIPTION

Figure 1:
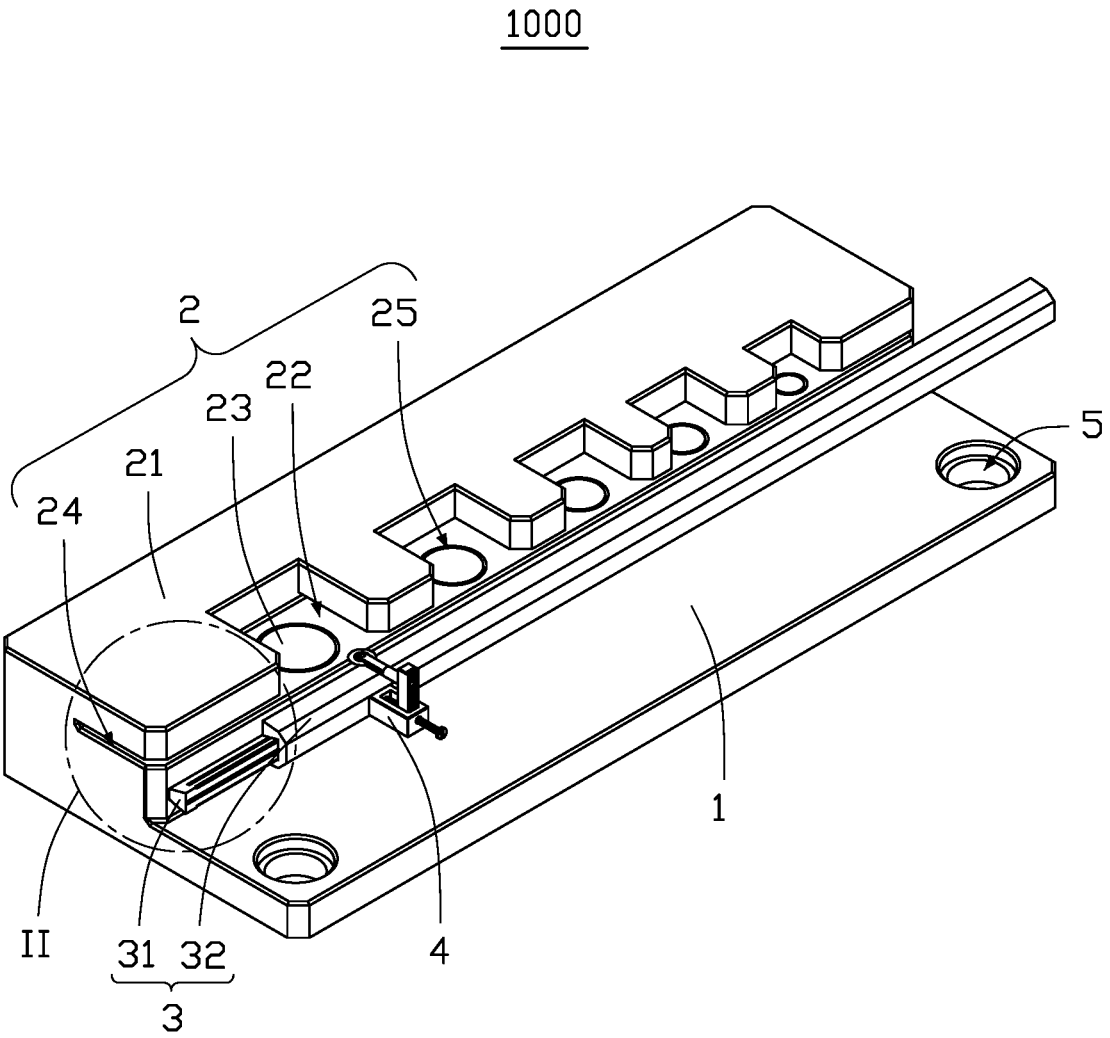
FIG. 1 is an isometric view of an embodiment of a cutting tool mechanism according to the present disclosure.
Figure 2:
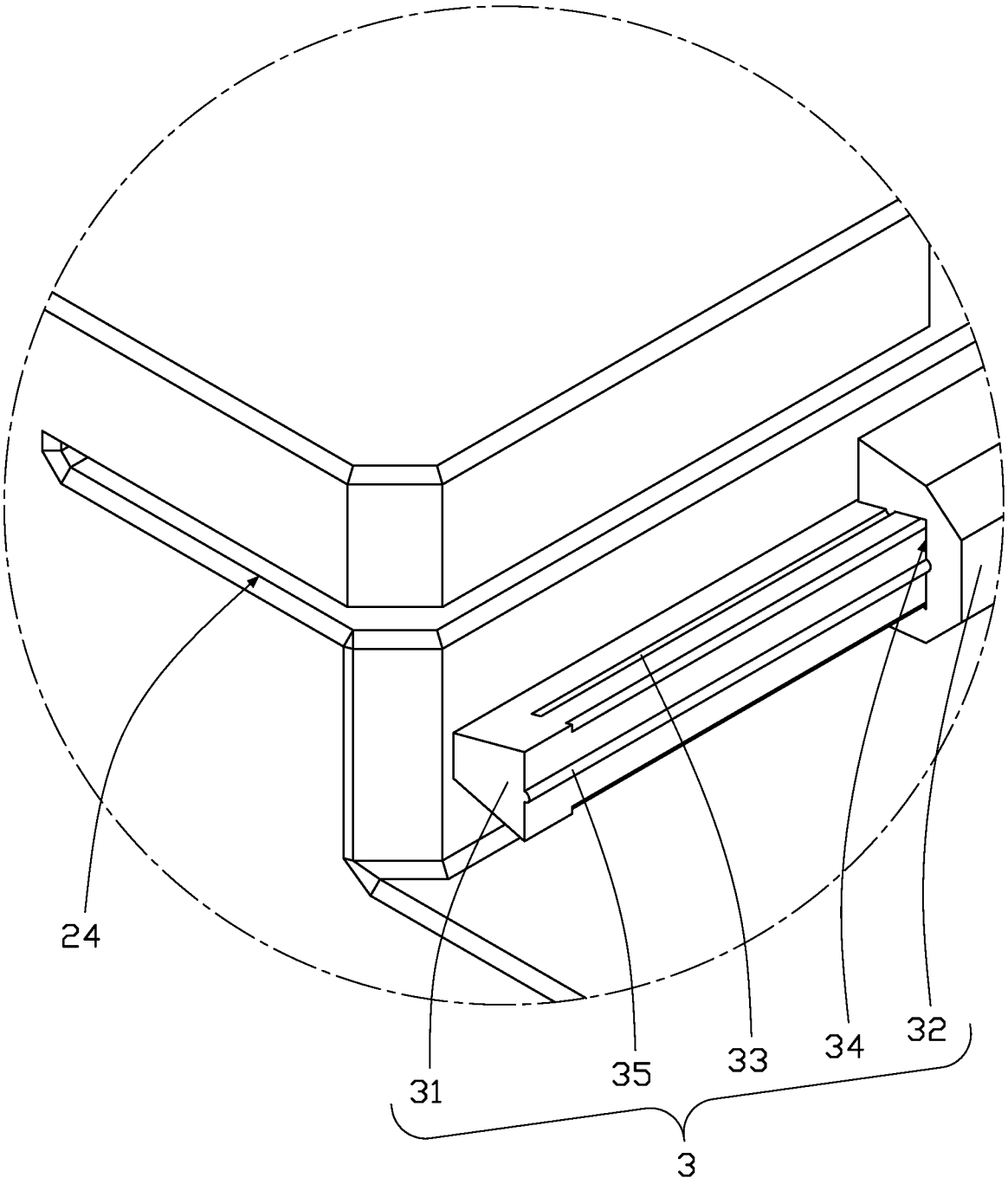
FIG. 2 is an enlarged view of a circled portion II of the cutting tool mechanism of FIG. 1.
Figure 3:
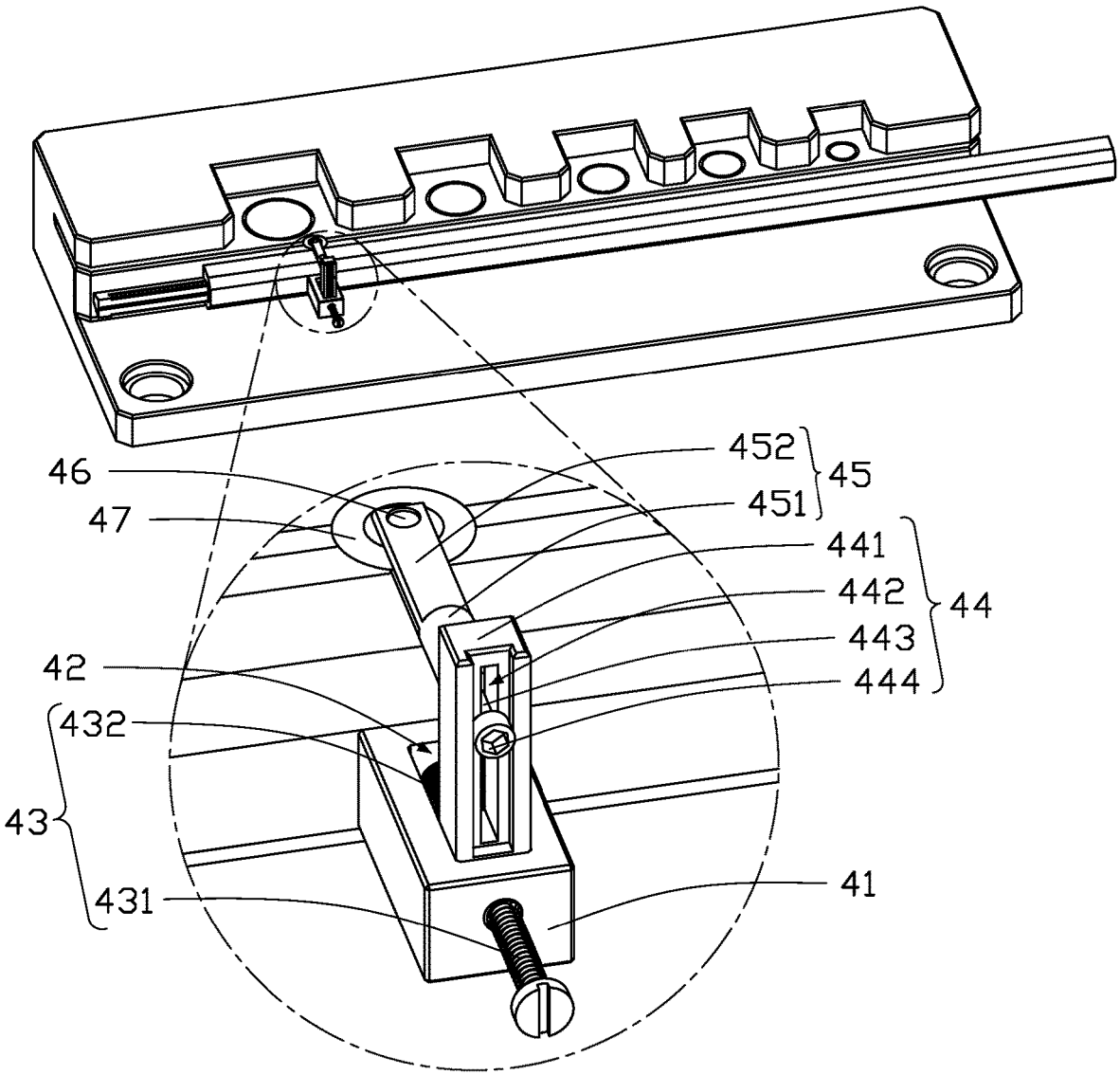
FIG. 3 is an isometric view of an embodiment of three-dimensional cutter of a cutting tool mechanism according to the present disclosure.
Figure 4:
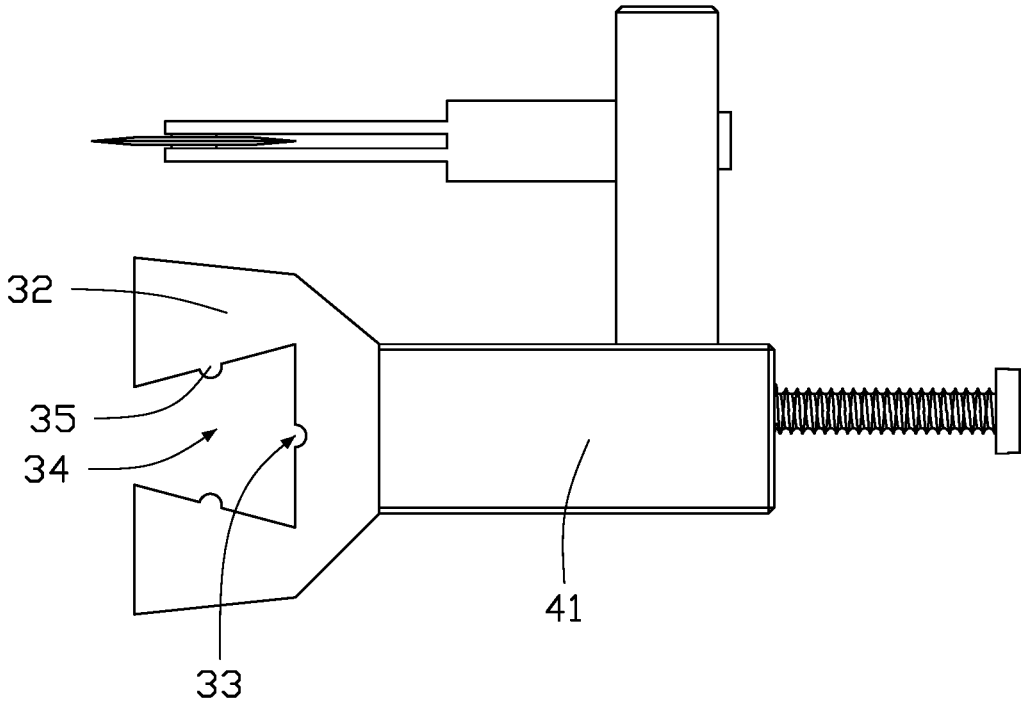
FIG. 4 is a side view of an embodiment of a moving portion of a cutting tool mechanism and a three-dimensional cutter according to the present disclosure.
Figure 5:
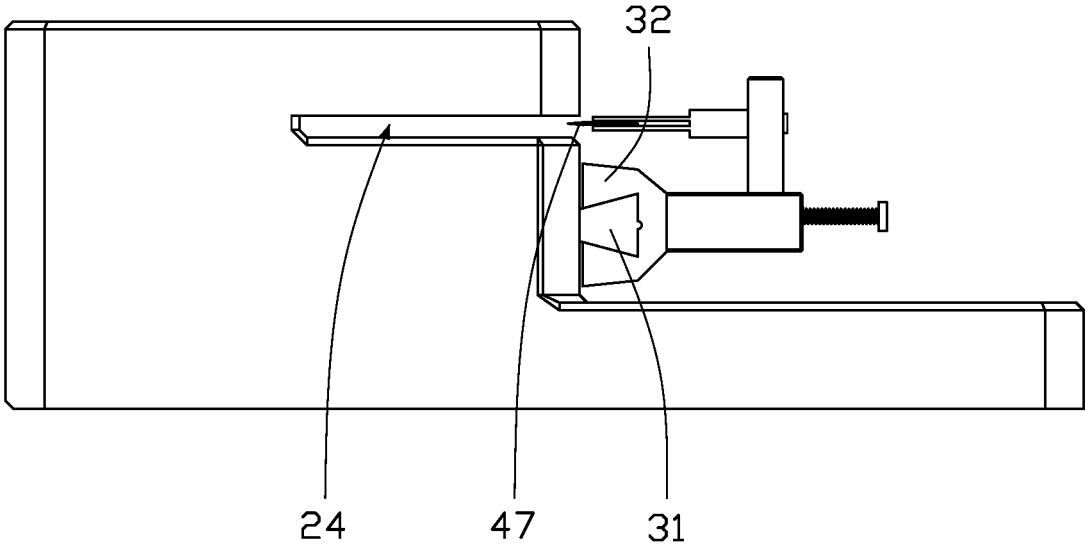
FIG. 5 is a side view of an embodiment of a cutting tool mechanism according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

FIGS. 1 to 5 illustrate an embodiment of a cutting tool mechanism 1000 which includes a base 1, a fixing module 2 disposed on the base 1 and configured for fixing a product to be disassembled, a first moving mechanism 3 disposed on a side of the fixing module 2, and a three-dimensional cutter 4 rotatably disposed on the first moving mechanism 3 and matched with the fixing module 2. The first moving mechanism 3 extends in a first direction, and the first moving mechanism 3 can drive the three-dimensional cutter 4 to move in the first direction. The three-dimensional cutter 4 can also move in a second direction and in a third direction, and each of the second direction and the third direction are perpendicular to the first direction. The three-dimensional cutter 4 has a three-dimensional structure. A fixing area of the fixing module 2 configured for fixing the product to be disassembled is matched with the structure of the product to be disassembled, which improves the positioning accuracy. By adopting the three-dimensional cutter 4, the position can be adjusted in three directions for rotary cutting, the cutting accuracy is improved. The fixing module 2 can fix at least one product to be disassembled. In other embodiment, the fixing module 2 can include a plurality of fixing areas which are configured for fixing a plurality of products to be disassembled respectively. In the embodiment, the product to be disassembled includes, but is not limited to a camera.

The base 1 defines a plurality of positioning holes 5. Through the positioning holes 5, the cutting tool mechanism 1000 can be detachably installed on a workbench (not shown) according to needs. Specifically, bolts can be inserted into the positioning holes 5 and installation holes of the workbench to fix the cutting tool mechanism 1000. The base 1 is made of metal. Specifically, the base 1 is made of iron with greater hardness.

The fixing module 2 includes a main body 21, at least one positioning groove 22 defined on the main body 21, a fixing device 23 disposed in the positioning groove 22 for fixing the product to be disassembled, and a cutting channel 24 defined on a side of the main body 21 close to the three-dimensional cutter 4. In the embodiment, the main body is substantially rectangular. In one embodiment, the fixing module 2 includes a plurality of positioning grooves 22 arranged side by side on the main body 21. The cutting channel 24 communicates with the positioning groove 22. An opening of the cutting channel 24 faces the three-dimensional cutter 4. A blade 47 of the three-dimensional cutter 4 can extend into the cutting channel 24 and can move back and forth along the cutting channel 24 under the drive of the first moving mechanism 3, so as to cut the product to be disassembled fixed in the positioning groove 22.

The main body 21 and the base 1 can be assembled or integrally formed. In the embodiment, the main body 21 and the base 1 are formed as an integral unit, a portion of the base 1 extends upwardly to form the main body 21. The main body 21 is also made of iron with greater hardness.

The shape of the positioning groove 22 is matched with the shape of the product to be disassembled, and the size of the positioning groove 22 is slightly greater than than the size of the product to be disassembled, thus the product is limited in the positioning groove to prevent the blade 47 from moving the product during the cutting process. A plurality of the positioning grooves 22 of the same size or different sizes can be defined on the main body 21 according to actual needs, so as to meet the requirement of disassembling multiple products to be disassembled of the same model or different models, the efficiency of disassembly is improved.

The fixing device 23 is disposed on a bottom of the positioning groove 22. The fixing device 23 may adopt a sinking design, that is, a groove 25 is provided at the bottom of the positioning groove 22, the fixing device 23 is arranged in the groove 25, and the upper surface of the fixing device 23 is flush with the bottom surface of the positioning groove 22. Thus, after the product to be disassembled is placed in the positioning groove 22, it is fixed to the fixing device, and a cutting height of the blade 47 can be controlled easily, ensuring the accuracy of disassembly, so as to avoid the damage of the product caused by the different cutting heights of blade 47 caused by the different heights of the fixing devices in different positioning grooves 22. In one embodiment, a magnetic device is disposed in the sinking groove 25, and the upper surface of the magnetic device is flush with the bottom surface of the positioning groove 22. After the product is placed in the positioning groove 22, the bottom surface of the product is in contact with the bottom surface of the positioning groove 22, thus the cutting height of the blade 47 is controlled easily.

The cutting channel 24 is formed on the sidewall of the main body 21 and is matched with the blade 47 of the three-dimensional cutter 4. A depth and a height of the cutting channel 24 can be designed as needs. A height of a portion of the product to be cut is within a height range of the cutting channel 24. In the embodiment, the size of the cutting channel 24 is suitable for most products to be disassembled. If it is used to other smaller or larger products, the height of the cutting channel 24 can be reduced or increased in a reasonable range. In the embodiment, the cutting channel 24 is a slit defined on the sidewall of the main body 21, the slit divides the main body 21 into two parts, an upper main body and a lower main body. The sidewalls of the plurality of positioning grooves 22 are defined side by side on the upper main body for limiting the product to be disassembled. The bottom of the positioning groove 22 is located on the lower main body, the groove 25 is defined on a top surface of the lower main body for holding the fixing device 23. The cutting channel 24 can accommodate the blade 47 of the three-dimensional cutter 4, thus a cutting height of the product to be disassembled can be the same, the cutting accuracy is improved, and the blade 47 is prevented from being exposed outside.

The first moving mechanism 3 includes a guide rail 31 and a moving portion 32 disposed on the guide rail 31. In the embodiment, the guide rail 31 is arranged along the edge of the main body 21 and is parallel to the cutting channel 24, that is, the first direction is consistent with the extending direction of the cutting channel 24. The guide rail 31 can be installed on the sidewall of the main body 21 by screws or other means and can also be installed on the top surface of the base 1. When the guide rail 31 is installed on the sidewall of the fixed part main body 21, it is more advantageous to avoid the difference in the distance between the different positions of the guide rail 31 and the fixed part main body 21 installed on the base 1, the cutting accuracy is improved. In the embodiment, the shape of the guide rail 31 is a wedge-shaped structure, and a plane with a narrow width of the wedge-shaped structure is attached to the main body 21 and is fixed to the main body 21. So that, the guide rail 31 can simultaneously bear up, down, left, and right load, it is not easy to deform. The moving portion 32 can be locked on the guide rail 31 to move back and forth. Specifically, the moving portion 32 is provided with a clamping slot 34 corresponding to the guide rail 31, and the guide rail 31 is movably received into the clamping slot 34. In order to make the moving portion 32 slide more stably and smoothly on the guide rail 31, at least one sliding groove 33 and/or at least one sliding bar 35 may be provided on the exposed surface of the guide rail 31, and the sliding bar 35 and/or the sliding groove 33 are correspondingly provided on the inner sidewall of the clamping slot 34. After the moving portion 32 is clamped on the guide rail 31, the sliding bar 35 can be clamped into the sliding groove 33, the moving smoothness and moving stability of the moving portion 32 on the guide rail 31 is improved, the positioning accuracy is improved.

The three-dimensional cutter 4 includes a fixing base 41, an adjusting groove 42 defined on the fixing base 41, a second moving mechanism 43 disposed in the adjusting groove 42, and a lifting mechanism 44 disposed on the second moving mechanism 43, a blade holder 45 disposed on the lifting mechanism 44, a rotating mechanism 46 disposed on one end of the blade holder 45, and the blade 47 disposed on the rotating mechanism 46. The second moving mechanism 43 is used to drive the blade 47 to move in the second direction and is used to adjust the distance that the blade 47 extends into the cutting channel 24. The lifting mechanism 44 is used to drive the blade 47 to move along the third direction and is used to adjust the cutting height of the blade 47, so that the cutting edge of the blade 47 can be at the position where the product to be disassembled needs to be cut. The rotating mechanism 46 is used to drive the blade 47 to rotate in a plane defined by the first direction and the second direction, and combined with the movement of the first moving mechanism 3 in the first direction, it can achieve the rotary cutting of the product to be disassembled.

The fixing base 41 can be disposed on a top surface or an outer sidewall of the moving portion 32 as needs. In one embodiment, the fixing base 41 is disposed on the outer sidewall of the moving portion 32, so that the blade 47 can more easily extend into the cutting channel 24, which facilitates the position adjustment operation of the blade 47 in the second direction.

The second moving mechanism 43 can drive the lifting mechanism 44 to drive the blade 47 to move in the second direction to adjust the distance that the blade 47 extends into the cutting channel 24. The specific structure of the second moving mechanism 43 is not limited, as long as the above adjustment purpose can be achieved. In one embodiment, the second moving mechanism 33 includes a push rod 431 and an elastic member 432. One end of the push rod 431 is fixed to one side of the lifting mechanism 44, and the other end of the push rod 431 extends out of the sidewall of the adjusting groove 42. The elastic member 432 is arranged inside the adjusting groove 42, one end of the elastic member 432 is fixed on the inner wall of the adjusting groove 42, and the other end of the elastic member 432 is fixed on the other side of the lifting mechanism 44. By rotating the push rod 431, the front and rear positions of the lifting mechanism 44 can be changed. When in use, when the push rod 431 is tightened, the lifting mechanism 44 moves forward, and the elastic member 432 is pressed during the movement, so that the blade 47 is moved forward. When the push rod 431 is rotated in the reverse direction to be loosened, the lifting mechanism 44 moves backward under the dual action of the pushing force of the elastic member 432 and the pulling force of the push rod 431, so that the blade 47 is moved backwards. The push rod 431 and the elastic member 432 cooperate with each other to improve the stability of the movement of the lifting mechanism 44 and the accuracy of the position movement. Specifically, the elastic member 432 is a spring. In addition, a scale may be provided on the upper surface of the fixing base 41, which can improve the accuracy of the movement of the second moving mechanism 43. The lifting mechanism 44 includes a lifting plate 441, an elongated opening 442 defined in the middle of the lifting plate 441, a positioning rod 443 extending through the opening 442, and a positioning head 444 disposed on an end of the positioning rod 443 away from the blade 47. The blade holder 45 is disposed on the other end of the positioning rod 443, and the blade holder 45 and the positioning head 444 are respectively located on either side of the lifting plate 441. In the embodiment, the positioning head 444 is a positioning nut. By loosening the positioning head 444, the positioning rod 443 can be moved up and down along the opening 442 to adjust a position thereof, after being adjusted to a preset height, the positioning head 444 is tightened to fix the blade holder 45 at the preset height. The lifting mechanism 44 has a simple structure and is convenient for lifting operations. In addition, a scale can be provided on the lifting plate 441, so that the height of the blade holder 45 can be adjusted more accurately, and the cutting height of the blade 47 can be adjusted.

The blade holder 45 includes a fixing portion 451 and a U-shaped portion 452 disposed on one end of the fixing portion 451. The other end of the fixing portion 451 is movably or fixedly connected to the positioning rod 443. In the embodiment, the fixing portion 451 is movably connected to the positioning rod 443. The fixing portion 451 is provided with a through hole in the middle, and one end of the positioning rod 443 is inserted into the through hole. The positioning rod 443 is screwed into or out of the through hole by the positioning head 444 to adjust the position. The opening of the U-shaped portion 452 faces the fixing module 2, and the blade 47 is rotatably connected to an end of the U-shaped portion 452 by the rotating mechanism 46.

The blade 47 is a circular blade and can rotate in the U-shaped portion 452. The material of the blade 47 is cemented carbide, diamond, tungsten steel, etc. The blade 47 has high wear resistance and oxidation resistance, and can cut a variety of materials, such as leather, rubber, film, tape, and the like.

The rotating mechanism 46 and the moving portion 32 are connected to a control device, so that a rotation speed of the blade 47 and a moving speed of the moving portion 32 are automatically and accurately controlled as needs.

The method of using the cutting tool mechanism 1000 to disassemble the camera includes steps as follows:

Moving the moving part 32 to an initial position, wherein the rotating three-dimensional cutter 4 is located at one end of a fixture;

Placing the product to be disassembled in the positioning groove 22 and fixing the product to be disassembled by the fixing device 23, wherein the portion of the product, to be disassembled, to be cut is located between the upper and lower surfaces of the cutting channel 24;

Adjusting the second moving mechanism 43 to move the blade 47 to extend into the cutting channel 24, wherein the cutting edge of the blade 47 faces the product to be disassembled;

Adjusting the lifting mechanism 44 to adjust a cutting height of the blade 47, wherein the cutting edge of the blade 47 is located corresponding to a cutting position of the product to be disassembled;

Turning on the control device to control the rotation speed of the blade 47 and the moving speed of the moving part 32 as needs to disassemble and cut the product to be disassembled.

In one embodiment, the fixing device 23 has a detachable structure. In one embodiment, the fixing device 23 is fixed on a sidewall of the positioning groove.

Figure 6:
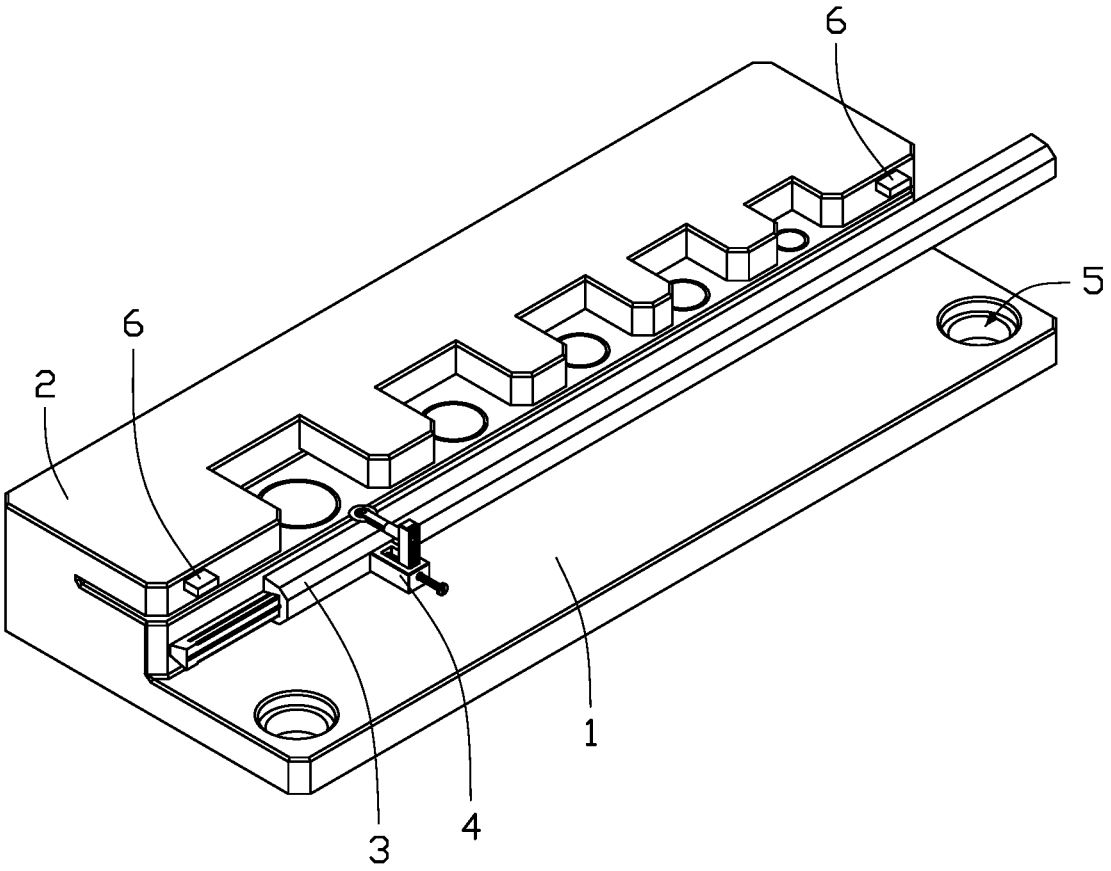
FIG. 6 is an isometric view of another embodiment of a cutting tool mechanism according to the present disclosure.

As shown in FIG. 6, the cutting tool mechanism 1000 further includes two displacement sensors 6 fixed on both ends of the fixing module 2 respectively. The displacement sensor 6 is used to sense the position of the moving portion 32 and send a signal to the controller, and the controller receives the signal and controls the moving portion 32 to stop moving as needs.

Compared with the prior art, the cutting tool mechanism has the following beneficial effects. First, the structure of the cutting tool assembly is simple, it is easy to disassembly and assembly, the hardness is large, and the cost is low. Second, the circular blade can balance the forces on the products to be disassembled, the camera can be disassembled at one time by using the circular blade, so that the integrity of the lens can be maintained. Third, the three-dimensional cutter is an automatically controlled cutter, the three-dimensional cutter cooperates with the moving mechanism to realize rotary cutting, which improves the safety and accuracy of operation, and effectively reduces the risk of scratches on the bottom of the lens in the camera module. Fourth, a plurality of positioning grooves suitable for a plurality of products are defined, the disassembly efficiency is improved; the product is fixed by a magnetic device, the positioning accuracy of the product is improved. Fifth, it realizes automatic control, the safety is improved.

While the present disclosure has been described with reference to particular embodiments, the description is illustrative of the disclosure and is not to be construed as limiting the disclosure. Therefore, those of ordinary skill in the art can make various modifications to the embodiments without departing from the scope of the disclosure as defined by the appended claims.

What is claimed is:

1. A cutting tool mechanism comprising:

a base;

a fixing module comprising a main body, wherein the main body defines a positioning groove and a cutting channel communicating with the positioning groove, the positioning groove is configured to fix a product to be assembled;

a first moving mechanism comprising a guide rail extending in a first direction and a moving portion movably disposed on the guide rail, wherein the guide rail is disposed on a top surface of the base or disposed on a sidewall of fixing module; and a three-dimensional cutter comprising a fixing base disposed on the moving portion, a second moving mechanism, a lifting mechanism, and a blade;

wherein the fixing base defines an adjusting groove, the second moving mechanism comprises a push rod extending in a second direction perpendicular to the first direction, the push rod extends through a sidewall of the adjusting groove; the lifting mechanism comprises a lifting plate and a positioning rod, an end of the lifting plate is accommodated in the adjusting groove and connected with the push rod, the lifting plate defines an opening extending in a third direction perpendicular to the first direction and the second direction, the positioning rod extends through the opening and is connected with the blade, the moving portion is configured to move the blade in the first direction, the push rod is configured to move the blade in the second direction to extend into the cutting channel, and the positioning rod is configured to move the blade in the third direction.

2. The cutting tool mechanism of claim 1, wherein the three-dimensional cutter further comprises a blade holder disposed on the positioning rod, the blade is connected to the blade holder.

3. The cutting tool mechanism of claim 1, further comprising a fixing device disposed on a bottom or a sidewall of the positioning groove.

4. The cutting tool mechanism of claim 3, wherein a groove is defined on the bottom of the positioning groove, the fixing device is disposed in the groove.

5. The cutting tool mechanism of claim 4, wherein the fixing device is a magnetic device.

6. The cutting tool mechanism of claim 2, wherein the second moving mechanism further comprises an end of the elastic member is connected to lifting plate, and the elastic member and the push rod are located on either side of the lifting plate respectively.

7. The cutting tool mechanism of claim 6, wherein the lifting mechanism further comprises a positioning head disposed on an end of the positioning rod, the blade holder is disposed on the other end of the positioning rod, the blade holder and the positioning head are located on either side of the lifting plate respectively.

* * * * *